United States Patent [19]

Parsons

[11] Patent Number: 4,625,498

[45] Date of Patent: Dec. 2, 1986

[54] APPARATUS FOR APPLYING RECESSED MEMBRANE SEALS TO CONTAINERS

[75] Inventor: Jack D. Parsons, Kansas City, Mo.

[73] Assignee: Sealright Co., Inc., Kansas City, Mo.

[21] Appl. No.: 715,904

[22] Filed: Mar. 25, 1985

[51] Int. Cl.[4] ..... B65B 7/28; B67B 5/00

[52] U.S. Cl. ..... 53/526; 53/298; 53/329; 156/261; 156/518

[58] Field of Search ..... 53/296, 297, 298, 329, 53/342, 373, 436, 478, 487, 488, 526; 156/261, 262, 518, 521

[56] References Cited

U.S. PATENT DOCUMENTS

| | | | |
|---|---|---|---|
| 2,086,552 | 7/1937 | Hogg | 226/85 |
| 2,413,449 | 12/1946 | Hatch | 93/55.1 |
| 2,866,308 | 12/1958 | Collins | 53/297 |
| 3,248,851 | 5/1966 | Ford | 53/478 |
| 3,660,965 | 5/1972 | Morera | 53/478 X |
| 3,688,464 | 9/1972 | Fox | 53/436 |
| 3,714,758 | 2/1973 | Vogeleer | 53/39 |
| 3,720,038 | 3/1973 | Bryan et al. | 53/478 X |
| 3,849,971 | 11/1974 | Granseus et al. | 53/329 |
| 4,035,987 | 7/1977 | Nakazato et al. | 53/329 X |
| 4,282,699 | 8/1981 | Embro, Jr. | 53/298 |
| 4,338,765 | 7/1982 | Ohmori et al. | 53/478 X |
| 4,362,002 | 12/1982 | Rowland et al. | 53/478 |
| 4,411,122 | 10/1982 | Cornish et al. | 53/526 X |
| 4,458,469 | 7/1984 | Dunn | 53/432 |
| 4,494,363 | 1/1985 | Rica et al. | 53/478 X |

*Primary Examiner*—E. R. Kazenske
*Assistant Examiner*—Michael D. Folkerts
*Attorney, Agent, or Firm*—Kokjer, Kircher, Bradley, Wharton, Bowman & Johnson

[57] ABSTRACT

A method and apparatus for applying and sealing recessed membranes to containers in a single operation. The membranes are partially cut from a continuous flexible web of film material and remain on the web due to thin necks of film material that are left after the cutting operation. An applicator head is carried on a power cylinder and acts to detach the membranes from the web, to apply the membranes to the containers at recessed locations, and to heat seal the marginal portions of the membranes to the container rims. The applicator head includes a vacuum head which attracts the membranes by suction and a sealing head which heat seals the membranes to the containers. The vacuum head has a tapered vacuum surface which properly centers the membranes and assists in expelling air from the containers before the heat seal is effected. The vacuum head is spaced from the heated sealing head to minimize the heat transfer and may be additionally cooled by a fluid cooling system.

18 Claims, 14 Drawing Figures

APPARATUS FOR APPLYING RECESSED MEMBRANE SEALS TO CONTAINERS

BACKGROUND OF THE INVENTION

This invention relates generally to the sealing of containers and more particularly to the application of a recessed membrane seal to a container of the type used to hold food products.

Food containers are typically sealed by a flexible membrane type seal which keeps the product clean, protects it from bacterial contamination, prevents it from being spoiled or otherwise harmed by air and foreign matter, keeps moisture either in or out, and also provides evidence of any tampering with the product that has taken place. The seals that are most often used are flat membranes which extend across the top of the container and are sealed to its rim. A replaceable lid normally covers the seal. This type of membrane is level with the top of the container and is not recessed below the container rim.

Membranes that are recessed into the container are used less frequently than flat membranes even though they are more advantageous for many types of products. The container is usually underfilled somewhat because of the difficulty of achieving a complete fill and also because liquid and semi-liquid products and even dry products can spill out of a completely filled container during subsequent handling before the seal can be applied. If the container is less than full and a nonrecessed membrane is applied, a considerable amount of air is entrapped in the top of the container and can degrade and otherwise damage the product. For example, any foods containing oils such as butter can become rancid if exposed to entrapped air. A recessed membrane also allows the lid to have a recessed top surface. This facilitates stacking and convenient display of the containers because the recessed surface of the lid provides space for stacking lugs.

Despite these advantages, recessed seals are not as popular as flat seals, primarily because of the expense and difficulty involved in forming, applying and sealing a recessed membrane. The recessed membranes that are used at present are preformed as individual pieces which are subsequently applied to the container and sealed in a separate operation. The membrane is usually formed off line on a separate machine, and this requires additional machinery, added factory space and extra manufacturing operations, all of which contribute to the overall cost. There are some recessed seal machines which preform the membrane seal from a continuous strip on the sealing machine itself. However, whether the membrane is formed on a separate machine or on the sealing machine itself, it must be made from a material which is stiff enough to hold its shape while the membrane is being applied to the container and sealed. Thin and/or non-ductile film materials cannot be used because of their inability to retain their preformed shape.

Another type of recessed seal currently in use is a flat disc membrane which is applied and sealed to an upwardly facing shoulder formed on the interior wall of the container at a location recessed below the rim. Shoulders of this type are practical only on plastic containers and are normally not used on paper or metal containers. Again, it is necessary for the membrane to be relatively stiff so that it can hold its flat shape until it is sealed to the shoulder.

Thus, the recessed membranes that have been used in the past are all relatively stiff because they must hold their shape until they have been sealed to the container. Consequently, thin films have not been used even though they are more desirable in a number of respects such as cost and performance. The stiffer materials are generally more costly and more difficult to remove and sometimes even require the use of a knife or other tool. Tear marks and grooves can be formed on the membrane to permit removal without tools, but this increases the manufacturing cost and machine complexity. Some seals require tearing in several places for removal, and this increases the inconvenience to the consumer. Pull tabs are for the most part impractical because they present additional difficulties in handling of the preformed membrane.

The stiff construction of the recessed membranes currently in use also generally eliminates transparent materials. For a number of reasons, it is desirable to provide the lid with a window having a transparent patch to keep out dirt which permits the contents to be viewed while the lid remains in place on the container. This increases the sales appeal of the product and eliminates the temptation for consumers to remove the lid so they can visually inspect the contents. Increased sanitary protection and enhanced tamper evident safeguards are also provided with this type of arrangement. However, it requires that the membrane be transparent and is thus not feasible with recessed seals formed by stiff opaque membranes.

SUMMARY OF THE INVENTION

It is the primary goal of the present invention to provide an arrangement which permits the use of a much wider variety of materials for recessed seal membranes, including plastic, foil and paper. The invention contemplates in particular the use of thin film materials which are incapable of holding their shape but which are more advantageous than stiff materials in a number of respects, most notably in their lower cost.

In accordance with the invention, a unique applicator head detaches a sealing membrane from a web of material, applies the membrane to the container at a recessed location, and heat seals its marginal portion to the container rim all in a single operation. The applicator head includes a vacuum head which attracts the membrane by suction to sever it from the web and insert it into the container while keeping it properly centered therein. An electrically heated sealing head provides an annular sealing surface which surrounds the vacuum head and acts to heat seal the membrane to the rim of the container. The sealing surface is spaced above the vacuum surface so that the membrane is recessed the proper distance below the container rim.

The sealing machinery includes on-line cutting dies which cut the membranes to the proper diameter from a continuous web of film material. The membranes are retained on the web by uncut necks of film material, or the membranes may be precut off-line and rewound into reels, in which case the on-line cutting dies are optional. In either case, the membranes are retained on the parent web by the necks and then are easily detached from the web by the applicator head.

The applicator head is located above the web and, each time a membrane is centered above a container, the applicator head is lowered by a power cylinder. The membrane adheres by suction to the vacuum head and is detached from the web as the vacuum head moves below the web to insert the membrane into the top of the container. When the membrane has reached the desired location recessed below the top of the rim, the heat sealing surface presses the margin of the membrane against the container rim and effects a heat seal. The film is coated with or laminated to a "heat-seal" material that adheres to the container rim when heated by the sealing surface.

The vacuum head is spaced from the heated sealing head by spacer pins which maintain an air gap in order to inhibit heat transfer from the heated sealing head to the vacuum head. Natural air cooling occurs by convection as air passes through the air gap and then through passages extending through the sealing head. Additional cooling can be provided by a cooling fluid such as water, or pumped air circulated through a cooling manifold carried on the vacuum head. Due to the air gap which is maintained between the vacuum and sealing heads and the natural air cooling that occurs, the need for additional cooling is minimized or eliminated to reduce the utility expense or cost and space required for external cooling equipment.

When viscous products are being handled, the vacuum surface is tapered from its center toward the edges. This allows the vacuum surface to grasp the membrane before the applicator head begins to move downwardly. Also, the tapered profile of the vacuum head drives entrapped air outward and vents it past the container rim before the container is sealed. The taper is more pronounced when flexible containers are used. The pressure buildup that results when the vacuum head enters the top of the container then creates a small outward bulge in the bottom of the container. The pressure buildup rapidly expels air from the top of the container and past the rim, thus enhancing the evacuation of air from the container. When the applicator head is retracted, the container bottom returns to its normal flat condition and the product and membrane are restored to a level profile.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
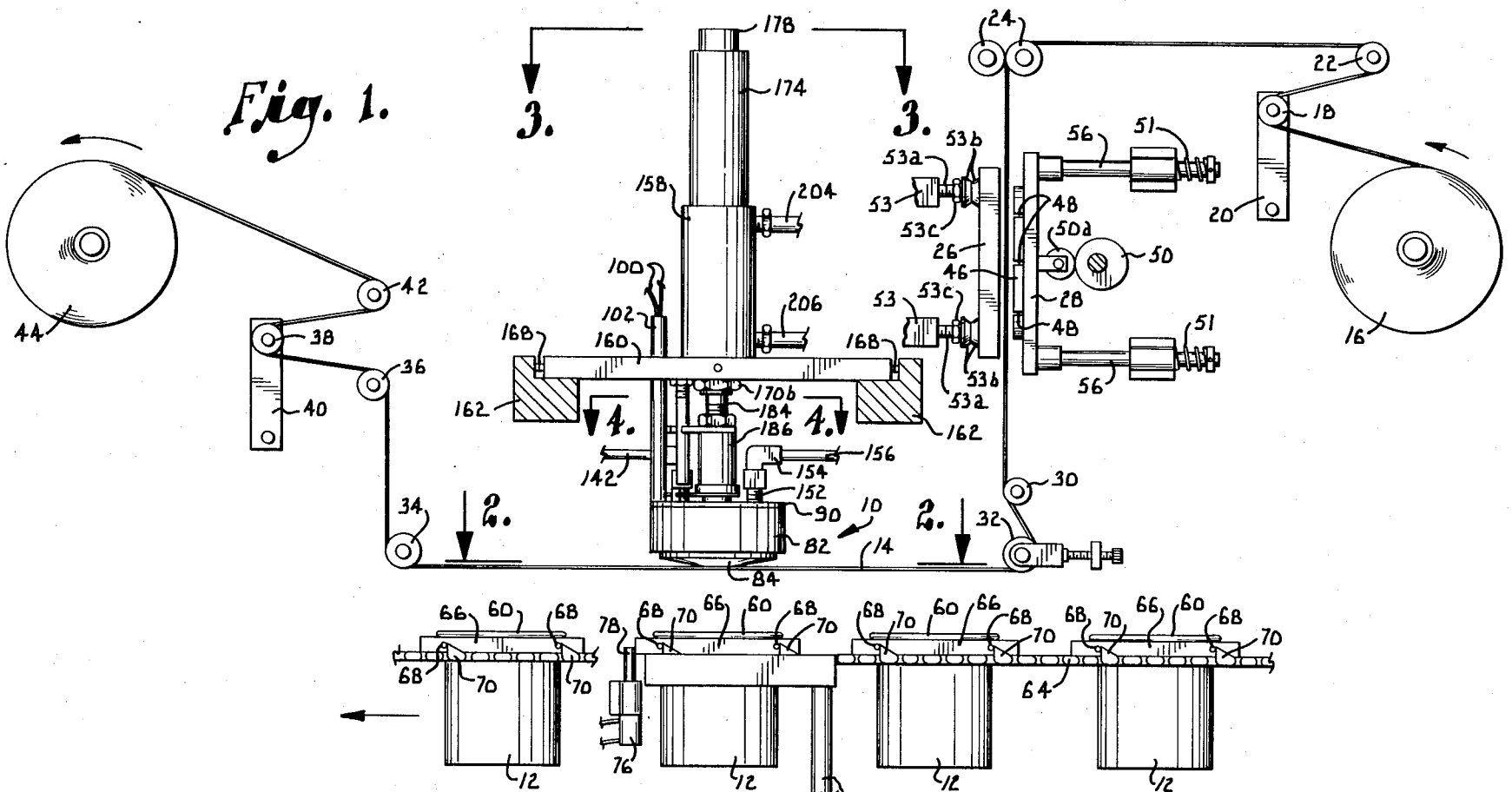
FIG. 1 is a front elevational view of a machine which operates to apply recessed membrane seals to containers in accordance with a preferred embodiment of the present invention.

Referring now to the drawings in more detail and initially to FIG. 1, numeral 10 generally designates an applicator head which applies and seals flexible membranes to open topped containers such as the paper containers 12. The membranes can be formed from a wide range of flexible materials such as plastic, foil and paper or laminated combinations of such materials. As shown in FIG. 1, techniques employed in the present invention permit the membranes to also be formed from a thin, transparent film material which is wound in a continuous ribbon or web 14 on a supply reel 16.

The web 14 of film material is drawn off of the supply reel 16 and passed around a roller 18 carried on a pivotal lever 20. The web is then drawn around a fixed roller 22 and passed between a pair of feed rollers 24 which are driven by a timed gear train (not shown). The web extends vertically between a pair of platen type cutting dies 26 and 28. The web is engaged against an idler roller 30 and drawn around an adjustable roller 32. The adjustability of roller 32 permits the membranes which are formed from the web to be accurately centered over the containers. The horizontal stretch of web 14 extends between the applicator head 10 and the underlying containers 12. The web of film material is then drawn around rollers 34 and 36 and around another roller 38 carried on a pivotal lever 40. The web is passed around roller 42 and wound on a take up reel 44 which is driven by a low torque motor (not shown). The take up reel receives the scrap material which remains on the web after the membranes have been removed.

Figure 2:
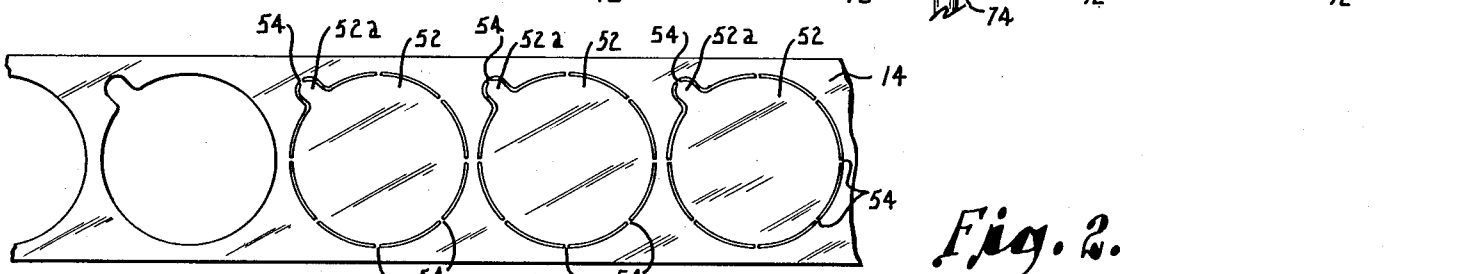
FIG. 2 is a fragmentary top plan view taken generally along line 2—2 of FIG. 1 in the direction of the arrows and showing membranes partially cut from a continuous web of film material.

Die 28 is provided with a cutting blade 46 which confronts the web 14 and the back up platen 26. Blade 46 is circular to conform with the circular rims of containers 12, although the die can have another shape if the containers are shaped differently. The blade 46 has a sharp cutting edge which is interrupted by a plurality of slits 48 spaced apart from one another. When timed, eccentric cam 50 is rotated in contact with roller 50*a*, platen 28 is extended and blade 46 cuts through the web 14 in order to partially cut from the web membranes 52 which are best shown in FIG. 2. As cam 50 is further rotated, springs 51 retract die 28. Platen 26 is mounted on rigid brackets 53 by means of threaded fasteners 53*a*. Conical springs 53*b* in combination with adjustment nut 53*c* provide controlled pressure between blade 46 and platen 26. Each membrane has a configuration (round, oval, rectangular, etc) suitable to seal the top of one of the containers 12. The membranes 52 shown in the drawing are circular. Due to the presence of the slits 48 in the cutting blade 46, the cut made by blade 46 is interrupted by a plurality of thin necks 54 which retain the membranes on the film web 14. Numeral 52*a* identifies a "pull-tab" for convenient removal of the membrane 52 from the sealed container. Guide rods 56 assist in guiding platen 28 as cam 50 rotates.

As an alternative to the platen type dies 26 and 28, the membranes 52 can be cut by a rotary type cutting mechanism having the cutting blade carried on a rotary drum. Alternatively, the membranes 52 may be completely cut off-line when the film is printed, slitted to proper width, and rewound to convenient weight and diameter. This is done only on printed film, as a printed registration mark on the web 14 is required to be used in conjunction with an electric eye on the machine to accurately center the membrane 52 over the container 12. In any event, the membranes are retained on the web 14 and are successively carried one at a time to a position immediately below the applicator head 10.

The film web 14 is coated or laminated to a heat-seal material so that the membrane 52 will adhere to the container rim when heated to a preselected temperature level (such as 275° F.), as will be explained more fully.

The containers 12 may be formed from any suitable material such as coated paper, and they may have virtually any suitable shape. The container shown in FIGS. 10–12 has a cylindrical body 58 which is outwardly rolled on its upper edge to form a rolled rim 60. The body 58 is provided with a bottom 62 of proper shape such as discoidal which is suitably secured to the inside surface of the container wall.

Referring again to FIG. 1, the containers 12 are carried one at a time to a position below the applicator head 10 by conveyor chains 64 which are suitably driven and controlled in their movement. Each container 12 is carried on a clamp 66 which is applied to the container immediately below its rim 60 so that the rim rests on the clamp. Each clamp 66 has a pair of projecting pins 68 which project from opposite sides of the clamp and are engaged by lugs 70 projecting upwardly from the conveyor chains 64. When each container 12 reaches a position immediately beneath the applicator head 10, its clamp 66 is received on a rigid holder 72. The holder is mounted on top of a support post 74.

At the membrane applicator station, a pneumatic cylinder 76 acts to stop each container 12 at the proper position aligned below the applicator head 10. The cylinder 76 extends and retracts a stop 78 which, when extended, is engaged by the clamp 66 on which the container 12 is carried. After a membrane has been applied to the container, the stop 78 is retracted so that the container conveying system can advance the next container to the applicator station.

The equipment previously described is conventional and has been used in the past in machines used to apply flat or nonrecessed membranes. The controls and drive system which cut the membranes and properly position them over the containers are well known in the industry.

Referring now more particularly to FIGS. 4–8, the applicator head 10 of the present invention includes as its two principal components a sealing head 82 and a vacuum head 84. Both are formed of aluminum or a similar material.

Figure 10:
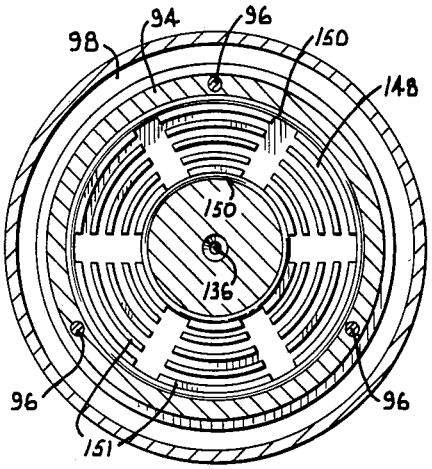
FIG. 10 is a fragmentary sectional view taken generally along line 10—10 of FIG. 5 in the direction of the arrows.

The sealing head 82 is optionally oval, rectangular, etc. depending on the shape of the container, but is shown here as cylindrical. Head 82 is heated by an electrical heating element 86. The heating element 86 takes the form of a coiled heater located in a cavity 88 formed in the top surface perimeter of the sealing head. The heater wire is enclosed in cavity 88 by a flat, cover 90 which is applied to the top surface of the sealing head 82 and secured in place by screws 91 (see FIG. 4). The lower part of sealing head 82 is formed by a skirt 92 which surrounds a manifold block 94. The vacuum head 84 is secured to manifold block 94 by screws 96. On the bottom of the skirt 92, a sealing surface 98 is formed with a shape (such as an annular shape) matching the geometry of the container. The sealing surface 98 has a configuration to conform generally with the rolled container rim 60, as best shown in FIG. 10. The heat which is generated by the electrical heating element 86 is conducted through the sealing head 82 to the sealing surface 98.

A pair of leads 100 connect with the heating element 86 and extend upwardly through a conduit 102. The lower end of the conduit 102 is threaded into cover 90 (see FIG. 4).

Figure 6:
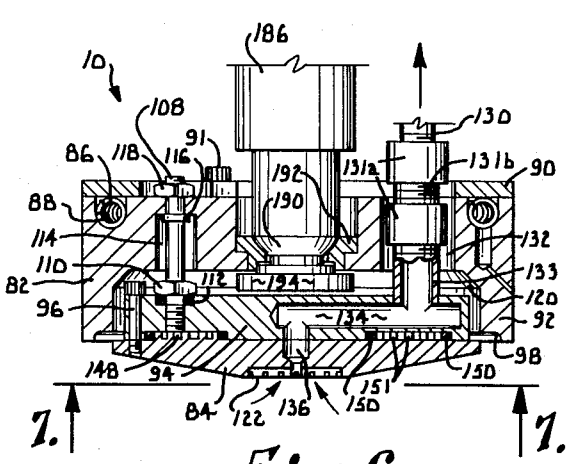
FIG. 6 is a fragmentary sectional view taken generally along line 6—6 of FIG. 4 in the direction of the arrows.

The vacuum head 84 is spaced from the sealing head 82 by three spacers formed by rigid studs 108. As best shown in FIG. 6, the lower end of each stud 108 is threaded into a passage formed in the manifold block 94. When the stud is fully threaded into the manifold block, an integral hex shape flange 110 on stud 108 engages and compresses an O-ring 112 against the manifold block. The shank portion of each stud 108 extends through a recess 114 formed in the sealing head 82. An integral flange 116 on stud 108 engages sealing head 82 at the upper end of the recess 114. A nut 118 is threaded onto the top end of each stud 108 in order to secure the stud to the sealing head.

The studs 108 thus to secure the sealing and vacuum heads 82 and 84 together while maintaining an air gap 120 between them. The air gap 120 serves to insulate the vacuum head from the heated sealing head so that the vacuum head will not be unduly heated by the heat that is generated in the sealing head. The studs 108 are constructed of a suitably rigid material which is resistant to the conduction of heat. Stainless steel is preferred. Only the relatively small part of each stud 108 located between flange 116 and nut 118 is in contact with the sealing head 82. This, together with the relatively distant location of each stud 108 from the heating element 86, further inhibits the transmission of heat from the sealing head 82 to the vacuum head 84.

Figure 11:
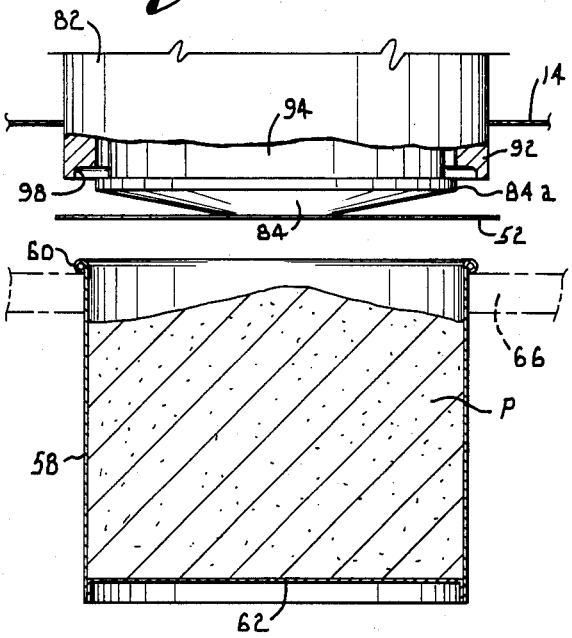
FIG. 11 is a fragmentary side elevational view showing the applicator head partially lowered toward a filled container to detach one of the membranes from the web of film material, with portions shown in section for illustrative purposes.
Figure 12:
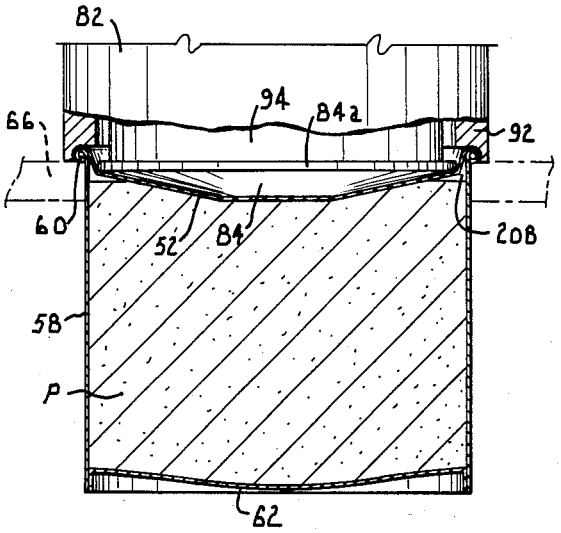
FIG. 12 is a side elevational view similar to FIG. 11 but showing the applicator head fully lowered to apply and heat seal the membrane to the container.
Figure 13:
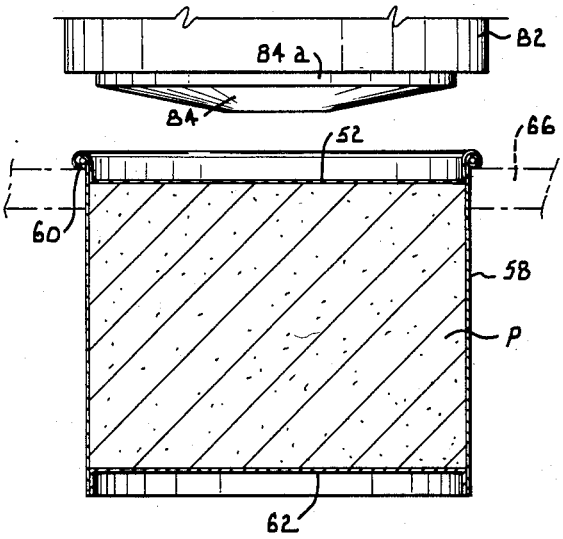
FIG. 13 is a side elevational view similar to FIGS. 11 and 12 but showing the applicator head retracted from the container after having applied and sealed the membrane thereto.

The flat bottom surface 122 of the vacuum head 84 is generally circular and acts as a vacuum surface to draw the membranes 52 against the vacuum head by suction. Outside of the center portion 122, the bottom surface of the vacuum head generally tapers toward the edges. Thus, the center portion 122 is the lowermost part of the vacuum head and is generally horizontal to conform with the horizontal stretch of web 14 which carries the membranes 52. Referring to FIG. 11, the sealing surface 98 generally surrounds the vacuum head and is spaced above the peripheral edge 84*a* of vacuum head 84 by a predetermined distance which conforms with the distance the membranes are to be recessed within the containers 12.

Figure 4:
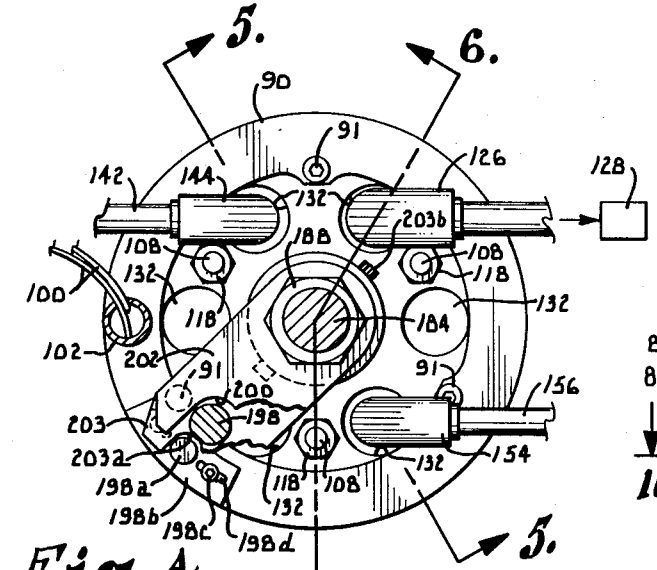
FIG. 4 is a fragmentary sectional view on an enlarged scale taken generally along line 4—4 of FIG. 1 in the direction of the arrows.
Figure 8:
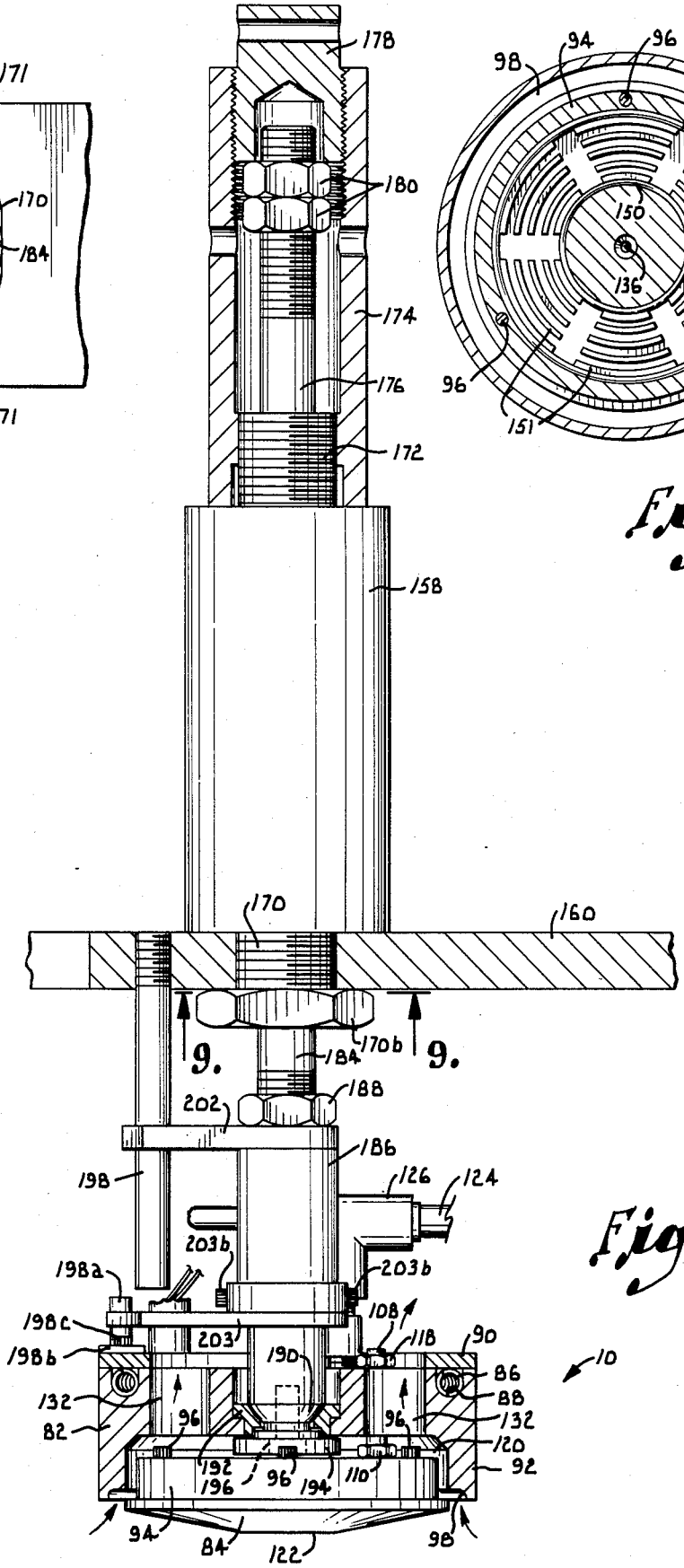
FIG. 8 is a fragmentary sectional view taken generally along line 8—8 of FIG. 3 in the direction of the arrows.

Vacuum is applied to surface 122 by a vacuum tube 124 which connects at one end with an elbow 126, as best shown in FIGS. 4 and 8. The other end of tube 124 communicates with a vacuum pump 128 (FIG. 4) which applies suction to tube 124 and removes the suction in a carefully controlled fashion. Another tube 130 (FIG. 8) connects with the vertical leg of elbow 126. Referring to FIG. 6, a pair of connectors 131*a* connect tube 130 with a short tube 131*b* and with another tube 133. The sealing head 82 is provided with six vertical passages 132, and the tubes and connectors extend through one of the passages 132, as best shown in FIG. 6. At its lower end, tube 133 connects with a vacuum passage 134 which extends within the manifold block 94. Passage 134 in turn connects with another passage 136 which is a vertical passage that leads to the center of the vacuum surface 122.

Figure 7:
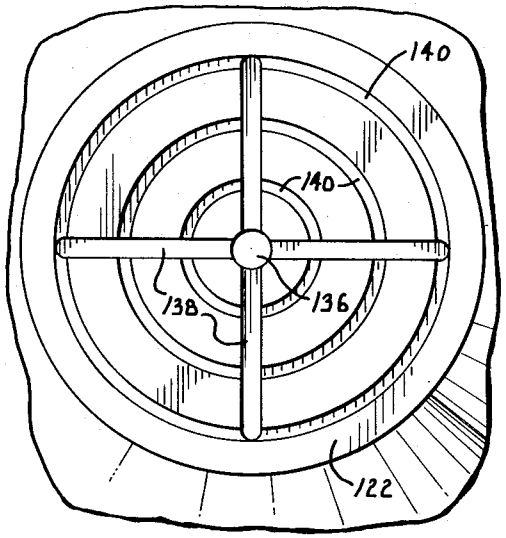
FIG. 7 is a fragmentary bottom plan view on an enlarged scale taken generally along line 7—7 of FIG. 6 in the direction of the arrows.

Referring now to FIG. 7 in particular, the vacuum surface 122 is provided with a pair of straight horizontal grooves 138 which intersect with one another at the vacuum passage 136. A series of circular grooves 140 are also formed in the vacuum surface concentric with one another and in communication with the diametrical grooves 138. This arrangement applies the suction force throughout the vacuum surface 122.

Figure 5:
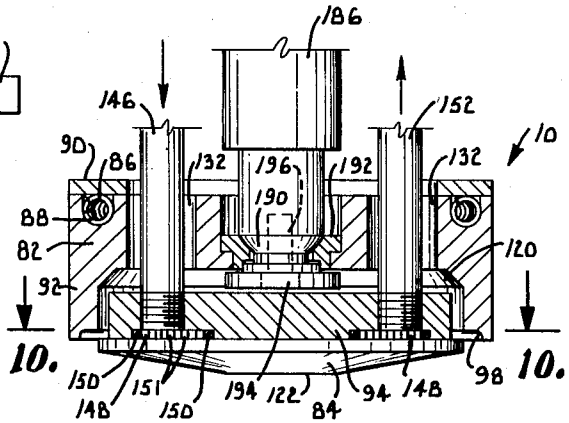
FIG. 5 is a fragmentary sectional view taken generally along line 5—5 of FIG. 4 in the direction of the arrows.

A fluid cooling system is also provided for cooling of the vacuum head 84. As best shown in FIGS. 4 and 5, the cooling system includes an inlet pipe 142 through which cooling fluid such as air or water is pumped. An elbow 144 connects pipe 142 with a vertical pipe 146 which extends through one of the passages 132 in the sealing head. At its lower end, pipe 146 is threaded into the manifold block 94. A cavity 148 (which may be annular) is formed between a pair of fluid seals 150 located at the intersection between the vacuum head 84 and the manifold block 94. Located in the cavity 148 is a series of upstanding ridges 151 which enhance cooling efficiency. An outlet pipe 152 connects with cavity 148 at a location diametrically opposed to the inlet pipe 146. Pipe 152 is threaded into block 94 at its lower end and connects at its upper end with an elbow 154. The horizontal leg of the elbow connects with a pipe 156 which directs the cooling water away from the applicator head. A suitable pump or other device (not shown) is used to pump or force the cooling fluid through the inlet piping and through cavity 148. Approximately half of the fluid circulates clockwise and the remainder counterclockwise through cavity 148, and the cooling fluid is then discharged through the outlet piping 152.

Figure 3:
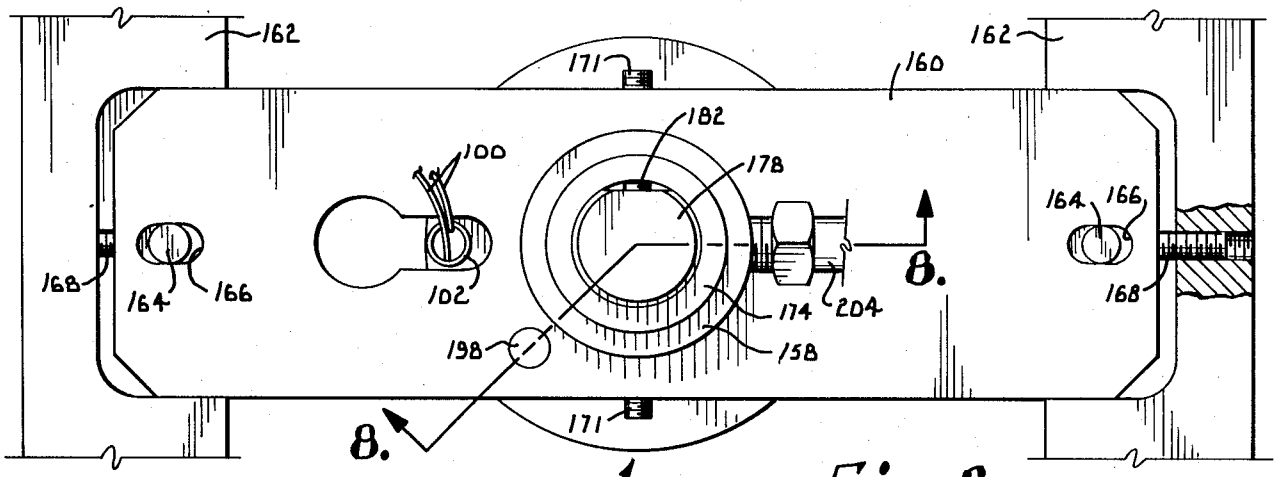
FIG. 3 is a fragmentary top plan view on an enlarged scale taken generally along line 3—3 of FIG. 1 in the direction of the arrows.

Referring to FIG. 1 in particular, the applicator head 10 is raised and lowered by a double acting pneumatic cylinder 158. The cylinder is supported on a horizontal mounting plate 160 which is in turn supported at its opposite ends on a pair of horizontal beams 162 forming part of the frame of the sealing machine. As shown in FIG. 3, the opposite ends of plate 160 are received on recessed ledges formed on beams 162. Studs 164 extend upwardly from the beams 162 through elongated openings 166 formed in the mounting plate 160. Horizontal adjustment screws 168 are threaded through the beams 162 and into the recessed areas where the tips of the screws engage the opposite ends of the mounting plate 160. By retracting one of the adjustment screws 168 and extending the other adjustment screw, the mounting plate 160 and the components it carries can be adjusted from side to side as desired.

Figure 9:
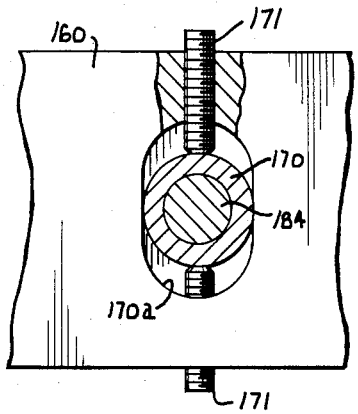
FIG. 9 is a fragmentary sectional view taken generally along line 9—9 of FIG. 8 in the direction of the arrows.

As best shown in FIGS. 8 and 9, a fitting 170 is threaded to the lower end of cylinder 158 through an elongated opening 170*a* in plate 160. The cylinder 158 is secured to the mounting plate by a threaded nut 170*b*. In like manner as described above, horizontal adjustment screws 171 are used to position the sealing head 10 accurately over the container 12. A similar fitting 172 is threaded to the top end of cylinder 158. A sleeve 174 is threaded onto fitting 172 and thereby mounted on top of the cylinder. A rod 176 is connected with the piston of cylinder 158. Rod 176 extends through fitting 172 and is located within the sleeve 174. Threaded into the upper end of sleeve 174 is an adjustable stop 178 having a cavity which receives the upper end of rod 176. A pair of nuts 180 are threaded onto rod 176 and contact the stop 178 in order to provide an upper limit of travel for the air cylinder. The position of nuts 180 can be adjusted on rod 176. A set screw 182 (see FIG. 3) is preferably threaded through one side of sleeve 174 and tightened against a flat formed on the stop 178 to prevent unintentional turning of the stop.

A threaded rod 184 is connected with and extends downwardly from the piston of cylinder 158 through fitting 170. A cylindrical plunger 186 is threaded onto the lower end of rod 184 and secured by a nut 188. The lower end portion of plunger 186 is reduced in diameter, and the tip of the plunger is machined to form a bearing surface 190. Preferably, surface 190 is a section of a sphere. The bearing surface 190 mates with and acts against a complemental surface formed on a seat member 192 mounted in a central bore formed through the sealing head 82. The seat member 192 has a flange which seats on a ledge formed within the sealing head bore.

A stepped disc 194 is connected with the lower end of plunger 186 by a screw 196. The disc 194 is larger than the opening formed through the seat member 192, and the disc thus raises the sealing head 82 and all attached parts when rod 184 is retracted. Disc 194 is located within the air gap 120 formed between the vacuum and sealing heads. There is sufficient play provided between seat member 192 and disc 194 to permit a limited amount of wobble of the applicator head. This permits the sealing surface 98 to accommodate irregularities in the rolled container rims 60 while at the same time applying substantially even pressure to the rim.

The drawings show a seal head assembly for circular containers for illustration purposes only. The concepts herewith apply to any of many shaped open top containers. For other than circular containers, the seal head assembly must be prevented from rotating in a precision manner, and yet it must allow the head to wobble to accommodate to the container top.

Referring to FIGS. 4 and 8 in particular, a vertical guide rod 198 extends downwardly from mounting plate 160. The guide rod 198 extends closely through a notch 200 formed in a guide bracket 202 which is secured to plunger 186. This prevents a clockwise or anticlockwise rotation of plunger 186. In like manner, a shorter lower guide rod 198*a* is mounted to heater cover 90 by mounting plate 198*b* and two screws 198*c*. The lower guide rod 198*a* extends closely through a notch 203*a* in a lower notched guide bracket 203 which is rigidly fastened to plunger 186 by two screws 203*b*. Thus, seal head 10 is prevented from clockwise or anticlockwise rotation but is still allowed to wobble a little by virtue of small movements of lower guide rod 198*a* relative to the fixed lower notched bracket 203.

On non-cylindrical containers, the parts serve only to prevent rotation of the vacuum head 84 and sealing head 82 which closely conform in shape to the shape of the non-circular container. Two slots 198*d* in mounting plate 198*b* are for fine rotational alignment of the seal head 10 to the container 12.

With reference to FIG. 1, the air cylinder 158 is operated by a pair of pneumatic lines 204 and 206. When air is applied through the upper line 204, the piston is forced downwardly, causing the lower rod 184 to extend and the upper rod 176 to retract. Application of air through the lower line 206 causes the piston to move upwardly and retracts the lower rod 184 and extends the upper rod 176. As previously indicated, the contact of nuts 180 against the threaded stop 178 limits the upwardly travel of the applicator head 10.

Additional applicator heads can be mounted on the beams 162, and additional production lines can be established to increase the capacity of the machinery.

In operation, the web 14 is advanced incrementally such that the membranes 52 are partially cut one at a time by the dies 26 and 28 and the partially cut membranes are fed one at a time to a location directly below the applicator head 10. At the same time, the conveyor chains 64 are incrementally advanced to sequentially position the containers 12 directly below the applicator head 10 and the membrane 52 which is to be applied. As shown in FIG. 1, the web 14 is preferably maintained in a tense condition at a location immediately below the applicator head 10.

When the web 14 of film material is stopped with one of the partially cut membranes 52 located below the applicator head, air is applied to the upper pneumatic line 204 to lower the applicator head. At the same time, suction is applied to the vacuum lines and the vacuum surface 122 of the vacuum head. The suction force attracts the membrane 52 against the vacuum surface, thus keeping the membrane properly centered relative to the underlying container 12.

As the vacuum head 84 moves below the web 14, the necks 54 break and the membrane 52 is then completely severed and detached from the web, as shown in FIG. 9. Additional lowering of the applicator head causes the vacuum head 84 to enter the top portion of the container 12 before the sealing surface 98 reaches the container rim 60. The product P in the container is normally mounded somewhat near the center, as shown in FIG. 9. The membrane 52 and vacuum head 82 contact the product P before the sealing surface 98 contacts rim 60. This causes a pressure build up within the container and results in outward bulging of the flexible container bottom 62, as shown in FIG. 10. The pressure build up also expels air from the top portion of the container and pushes the air out past the rim 60. When the sealing surface 98 thereafter presses the marginal portion of the membrane 52 against the rim and effects a heat seal, virtually all of the air is evacuated from the top portion of the container, as will be explained more fully.

After the marginal portion of the membrane 52 has been heat sealed to the rolled rim 60 in the position of FIG. 10, air is applied to line 206 to effect raising of the applicator head to the position of FIG. 11. Immediately prior to raising of the applicator head, the suction is cut off and the vacuum tubing is vented to the atmosphere so that the vacuum surface 122 will not continue to adhere to the film material. Venting of the vacuum tubing allows air to flow through it to the area of surface 122 to counter any tendency for the vacuum head to lift the film as it is separated. After the applicator head has been retracted, the container bottom 62 returns to its normal position, and the top of the product P and the membrane 52 are restored to a level profile, as shown in FIG. 11. Thus, the membrane is applied to the container, formed to the proper shape and sealed, all in a single stroke of the cylinder and with evacuation of air.

Web 14 and the conveyor chains 64 are then incrementally advanced to properly position the next membrane and container prior to the next stroke of cylinder 158. The sealing machinery continues to operate sequentially in this manner to successively seal the containers which are eventually disdharged from the conveyor chains. A recessed lid (not shown) may be applied to each container to cover the membrane.

Preferably, the velocity of the applicator head is decreased in a controlled manner in the last fraction of an inch before the cylinder 158 reaches the bottom of its stroke. This prevents undue internal pressure from building up in the container and avoids possible damage to the container. The decrease in the applicator head velocity is accomplished by using conventional fluid cushions in the air cylinder 158. In addition, the slow down of the applicator head provides a brief time interval during which the air is vented from within the container prior to sealing of the membrane against the container rim. There is preferably only a small clearance 208 (shown exaggerated in FIG. 12 for clarity) between the edge of the vacuum head 82 and the container wall so that the viscous liquid or paste like product P is not allowed to flow along with the relatively low viscosity air into the area of the heat seal during the brief interval needed to vent the entrapped air. Consequently, the air is virtually eliminated from the container without the loss of any product. If the mounded top portion of the product is off center as is often the case, the product is not allowed to escape even on the heavily filled side, while the air rapidly escapes on the side which is more lightly filled, thereby providing a level top surface of the product without creating any mess or voids.

The tapered shape of the bottom surface of the sealing head 82 facilitates evacuation of air because the shape of the vacuum head causes the air to move from the center toward the edges of the container before the membrane is sealed to the container rim. In addition, the vacuum can be applied immediately upon stopping of the film, and the vacuum head can thus immediately grasp the membrane in a firm manner prior to downward movement of the applicator head. By quickly grasping the membrane in this manner, the cycle speed can be increased and it is necessary to provide only one relatively small vacuum source for several of the applicator heads. The taper also allows the web 14 to be advanced while it is in contact with the cool vacuum surface 122 without becoming entangled in the heated sealing head. It is contemplated that a vacuum sensor (not shown) will be provided to allow the machine to detect whether or not film is present beneath the applicator head. In the absence of film, the applicator head is prevented from moving downwardly into the product.

The lower surface of the vacuum head is preferably tapered more aggressively when the container has a flexible bottom such as a paper bottom. Then, the bottom can bulge outwardly as previously described. The vacuum surface is also tapered more aggressively when flexible containers such as paper or plastic are being handled because of the enhanced air expulsion that results from increased taper. If the product is dry or nonviscous, entrapped air is normally not a significant problem, and the vacuum surface can be tapered less aggressively and can even be flat in many instances. The taper causes air to move from the top center of the product to the perimeter where it can escape from the container in order to avoid entrapment of an air bubble directly under the center of the membrane. The bulge at the bottom prevents trapped air at the perimeter. Thus, the taper is responsible for two separate phenomena, namely the pushing of air to the perimeter and avoidance of air entrapment at the perimeter.

The heat which is generated by the electric heating element 86 is efficiently utilized. A conventional thermostat is used to maintain the temperature of the sealing surface 98 at a preselected level (such as 275° F.) which is most suitable for the heat sealing of films which are coated with any of many "heat-seal" materials. At the same time, the air space 120 which is provided between the vacuum and sealing heads prevents the vacuum head from being heated and possibly creating problems with heat sensitive products. Additional cooling results from the natural convection of air that occurs as the applicator head is moved up and down. The air flows through the air space 120 and the passages 132 that extend through the sealing head 82, as indicated by the directional arrows in FIG. 8. Because of the efficient cooling that results from this arrangement, little if any additional fluid cooling is required in most cases. Consequently, fluid cooling need not be used to any significant extent and normally involves the use of only a relatively small flow of cooling fluid such as water or compressed air. Because the fluid cooling requirements are small, cooling equipment cost and utility expenses are minimized or eliminated entirely.

The sealing surface 98 is located above the edge 84*a* of the vacuum head 84 by a predetermined distance which corresponds to the distance the membrane is to be recessed below the rim 60. Consequently, the membrane is recessed to the location which allows it to closely conform to the product level. The manner in which the membranes are applied and sealed to the containers permits them to be forced from virtually any flexible material, including plastic, foil and paper. Particularly significant is the ability to use thin film materials that are not able to hold their own shapes. These thin materials are normally economical and many are transparent so that the lid which is subsequently applied to the container can be provided with a window that permits the product to be viewed while the lid remains in place. This enhances the sales appeal and the sanitary condition of the product.

The sturdy container holder 70 and clamp 66 retain the container securely in place as the membrane is being applied to it. The containers 12 essentially serve as the lower half of a die, the upper half of which is formed by the applicator head.

Figure 14:
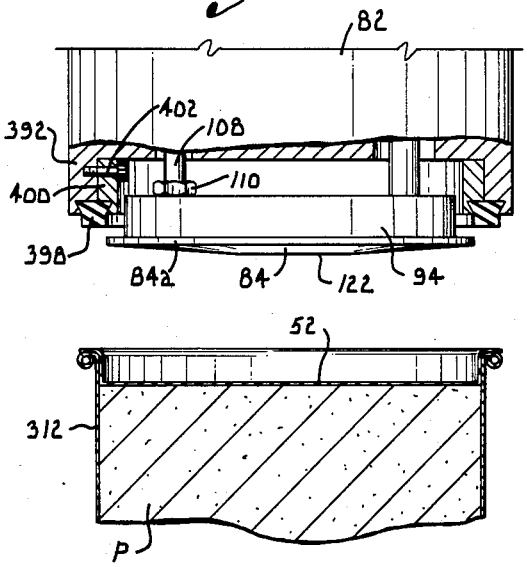
FIG. 14 is a side elevational view similar to FIG. 13 but showing a silicone rubber seal ring on the applicator head for use with rigid containers in accordance with a modified form of the invention.

FIG. 14 illustrates an alternative embodiment of the applicator head which is for the most part identical to the applicator head described previously. The embodiment shown in FIG. 14 is used to apply flexible membranes 52 to more rigid containers such as containers formed from metal or glass. The container 312 shown in FIG. 14 is formed from metal and has a flat upper rim rather than a rounded rim.

The applicator head shown in FIG. 14 eliminates the aluminum sealing surface 98 and replaces it with a silicone rubber sealing ring 398. Ring 398 has a flat annular sealing surface which presses and heat seals the marginal portion of the diaphragm 52 to the container rim. The upper portion of ring 398 has a dovetail shape and is received partially in the skirt portion 92 of the sealing head and partially by three or more clamp rings 400 which are applied to the inside surface of the skirt 392 and secured thereto by a plurality of screws 402. The wobble provided by the bearing surface 190, disc 194 and bearing surface 192 is not usually necessary in the FIG. 14 arrangement, and these components can be eliminated if desired. In other aspects, the applicator head of FIG. 14 is identical to that described previously, although the taper of the vacuum surface is decreased because of the rigidity of the container 312.

The silicone rubber seal ring 398 is better able to conform with irregularities in the container rim than the more rigid aluminum sealing surface 98. Consequently, the rubber seal ring provides a more effective seal in many situations, including those where the container rim has a seam or other irregularity. By accommodating the irregularities with the seal ring 398, the seal between the membrane and container can be made more air tight than can occur with a more rigid sealing surface. Because the container 312 is rigid, the tapered shape of the vacuum head leaves a slightly tapered profile on the surface of the product P and membrane 52. This is changed to a flat profile when the lid is subsequently applied.

Because of the construction of the applicator head, thin film materials can be used as well as the more traditional materials. The vacuum head 84 properly forms and shapes the membrane prior to sealing of its margin to the container rim, so stiff materials need not be used although they can be. The outer edge of the vacuum head preferably presents a corner which barely clears the container wall to properly shape the membrane while preventing escape of the product. The upper cylinder rod 176 assists in maintaining the alignment of the applicator head and assures that it will clear the container wall.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Apparatus for applying a flat flexible membrane to a container having a rim, said apparatus comprising:

a frame;

an applicator head for applying the membrane to the container, said applicator head having a vacuum surface for applying suction to the membrane and a sealing surface for sealing a marginal portion of the membrane to the rim of the container, said vacuum surface and sealing surface being rigidly connected to one another in the applicator head;

means for mounting said applicator head on the frame for generally up and down movement between a raised position wherein the applicator head is located above the container and a lowered position wherein said vacuum surface is lowered into the container a predetermined distance below the rim and said sealing surface is on the rim of the container;

means for applying suction to said vacuum surface;

means for maintaining a flat web of material under tension with the membrane carried on the web and located between the container and applicator head in the raised position of the latter;

power means for effecting movement of said applicator head from the raised position to be lowered position to effect adherence of the membrane to said vacuum surface by suction and detachment of the membrane from the web as said vacuum surface moves below the web and into the container, said vacuum surface projecting beyond said sealing surface to deform and recess the membrane said predetermined distance below the rim of the container before a marginal portion of the membrane is engaged against the rim of the container by said sealing surface; and means for heating said sealing surface to heat seal the marginal portion of the membrane to the rim of the container with the membrane recessed below the rim.

2. Apparatus as set forth in claim 1, including:

a vacuum head in said applicator head presenting said vacuum surfaces thereon;

a sealing head in said applicator head presenting said sealing surface thereon; and means for rigidly connecting said vacuum and sealing heads together with an air space presented therebetween to inhibit transmission of heat from the sealing head to the vacuum head.

3. Apparatus as set forth in claim 2, wherein:

said connecting means located said sealing surface in extension generally around the vacuum surface and above same by said predetermined distance.

4. Apparatus as set forth in claim: 2, wherein said vacuum surface is generally flat and said vacuum head includes a tapered surface surrounding the vacuum surface for expelling air from the container prior to sealing of said marginal portion against the rim.

5. Apparatus as set forth in claim 2, including an air passage in said sealing head for accommodating flow of air through said air space and passage to cool the vacuum head.

6. Apparatus as set forth in claim 2, including means for circulating a cooling fluid adjacent said vacuum head for cooling thereof.

7. Apparatus as set forth in claim 6, including an air passage in said sealing head for accommodating flow of air through said air space and passage to cool said vacuum head.

8. Apparatus as set forth in claim 2, wherein said connecting means includes a plurality of rigid spacers extending between said vacuum and sealing heads, said spacers being constructed of a rigid material resistant to conduction of heat.

9. Apparatus as set forth in claim 1, wherein said vacuum surface is generally flat and is surrounded by a tapered surface which tapers from the center toward the edges to facilitate expulsion of air from the container.

10. Apparatus as set forth in claim 2, wherein said heating means includes an electric heating element mounted in a cavity in said sealing head.

11. Apparatus for applying to a container rim a flexible membrane carried to a position aligned above the container on a continuous flat web of flexible material which is non-ductile and unable to sustain a preformed shape, said apparatus comprising:

an applicator head having a vacuum head for applying suction to the membrane and a sealing head for heat sealing a marginal portion of the membrane to the container rim, said vacuum head having a vacuum surface and said sealing head having a sealing surface;

means for rigidly connecting said vacuum head to said sealing head with an air space therebetween to inhibit heat transmission and with said sealing surface generally surrounding said vacuum surface and spaced above same by a predetermined distance;

means for applying suction to said vacuum surface to effect adherence of the membrane thereto;

means for applying heat to said sealing head and sealing surface to effect heat sealing of the marginal portion of the membrane to the container rim when said marginal portion is pressed against the rim by said sealing surface; and power means for moving the applicator head from a raised position above the web to a lowered position below the web to effect adherence of the membrane to the vacuum surface by suction and detachment of the membrane from the web, said sealing surface pressing and heat sealing the marginal portion of the membrane against the rim in the lowered position and said vacuum head entering the container in the lowered position to recess the membrane below the container rim by said predetermined distance before said sealing surface presses said marginal portion against the rim.

12. Apparatus as set forth in claim 11, including means for providing a continuous flow path for air through said air space for cooling of the vacuum head.

13. Apparatus as set forth in claim 12, including means for circulating cooling fluid adjacent said vacuum head.

14. Apparatus as set forth in claim 11, wherein said heat applying means includes an electric heating element adjacent said sealing head.

15. Apparatus as set forth in claim 11, wherein said connecting means includes a plurality of rigid spacer elements extending between said vacuum head and said sealing head in a manner to space the vacuum and sealing heads apart, said spacer elements being resistant to heat conduction.

16. Apparatus as set forth in claim 11, wherein said vacuum head has a tapered configuration to facilitate expulsion of air from the container.

17. Apparatus as set forth in claim 11, wherein:

the container holds a viscous product and has a flexible bottom; and said vacuum surface has a center portion and an edge portion and tapers from said center portion toward said edge portion, said center portion contacting the product before said lowered position of the applicator head is reached to effect pressure in the container causing the container bottom to bulge and air in the container to escape past the rim before the marginal portion of the membrane is sealed thereto by the sealing surface.

18. Apparatus as set forth in claim 17, wherein said center portion of the sealing surface is flat.

* * * * *